US007598860B2

(12) United States Patent
Niemi

(10) Patent No.: US 7,598,860 B2
(45) Date of Patent: Oct. 6, 2009

(54) SCANNING DEVICE WITH SENSORS AND CAMERA OR TRICORDER

(76) Inventor: Michael Francis Niemi, 3855 W. 5400 South PMB 128, Taylarsville, UT (US) 89118

( * ) Notice: Subject to any disclaimer, the term of this patent is extended or adjusted under 35 U.S.C. 154(b) by 86 days.

(21) Appl. No.: 11/935,438

(22) Filed: Nov. 6, 2007

(65) Prior Publication Data

US 2008/0088443 A1 Apr. 17, 2008

Related U.S. Application Data

(63) Continuation-in-part of application No. 10/621,013, filed on Jul. 17, 2003, now abandoned.

(51) Int. Cl.
*G08B 21/00* (2006.01)

(52) U.S. Cl. ..... 340/540; 340/500; 340/521

(58) Field of Classification Search ..... 340/540, 340/500, 521

See application file for complete search history.

(56) References Cited

U.S. PATENT DOCUMENTS 6,470,273 B2 * 10/2002 Halsted et al. ..... 701/301
6,518,881 B2 * 2/2003 Monroe ..... 340/539.1
2003/0090568 A1 * 5/2003 Pico ..... 348/148
2005/0012819 A1 * 1/2005 Niemi ..... 348/148

* cited by examiner

*Primary Examiner*—Toan N Pham
*Assistant Examiner*—Travis R Hunnings

(57) ABSTRACT

An application to use of a robotic controller board to manage the influx of data from one or more sensors, and to send that data, in RS232 or serial form, to a Computing Device (see CLAIM VIII). In this case, the images attached are created from a Prototype built for a Palm Handspring Visor Prism PDA with an Eye Module 2 Camera to sense heat, motion, direction and distance from objects from the Scanning device. The Prism also has onboard Clock and Palm OS software that can be used, like Notepad, to take notes, and other built in applications for the user to store data about an incident(s) that the Scanner is recording or had recorded. The Application in its prototype form, and as shown, is short ranged and is meant to be used by a coordinated number of users to find changes hazardous to human life.

6 Claims, 5 Drawing Sheets

HANDHELD SCANNER SENSOR PACK FIGURE 1D.

SCANNING DEVICE WITH SENSORS AND CAMERA OR TRICORDER

This application is a continuation in part of Ser. No. 10/621,013 filed Jul. 17, 2003 now abandoned.

The Handheld Scanner or Tricorder is a combination of devices assembled in a new way to provide users a handheld way to record threats or events detrimental to Human life. The basic structure is a computing device (see CLAIM VIII) as seen built in the prototype (see FIG. 1*a*) of that of a Palm OS PDA (in this case the Handspring Visor Prism running Palm OS 8.01 operating system) attached on top of a Sensor Pack that is fully independent in operation to the computing device, that can hold sensors (see FIG. 1*b*) in a separate case that detects in which the prototype can detect Radiation (see Geiger Muller Tube in FIG. 1*d*), Heat, UV, Smoke, movement, direction via electronic Compass or GPS device and can alert the user visually. It also allows the user to make use of third party Mapping software called StreetMaps, which has been loaded into the Prototype, and the ability to use the any of the other software built into shown Prism software to record photographs of the scene and take notes or other software present. The Application in its prototype form, and as shown, is short ranged and meant to be used by a coordinated number of users to find changes The Sensor Pack is controlled by a BrainStem robotic controller that takes in data in from sensors attached to its main three (3) input ports (see FIG. 1*c*), it can accept raw data from any kind of sensor in Analog, Serial or IIC (I squared C) formats. The Programming (see FIG. 1*d*) of the Brainstem steps to each sensor in round robin fashion.

Figure 1A:
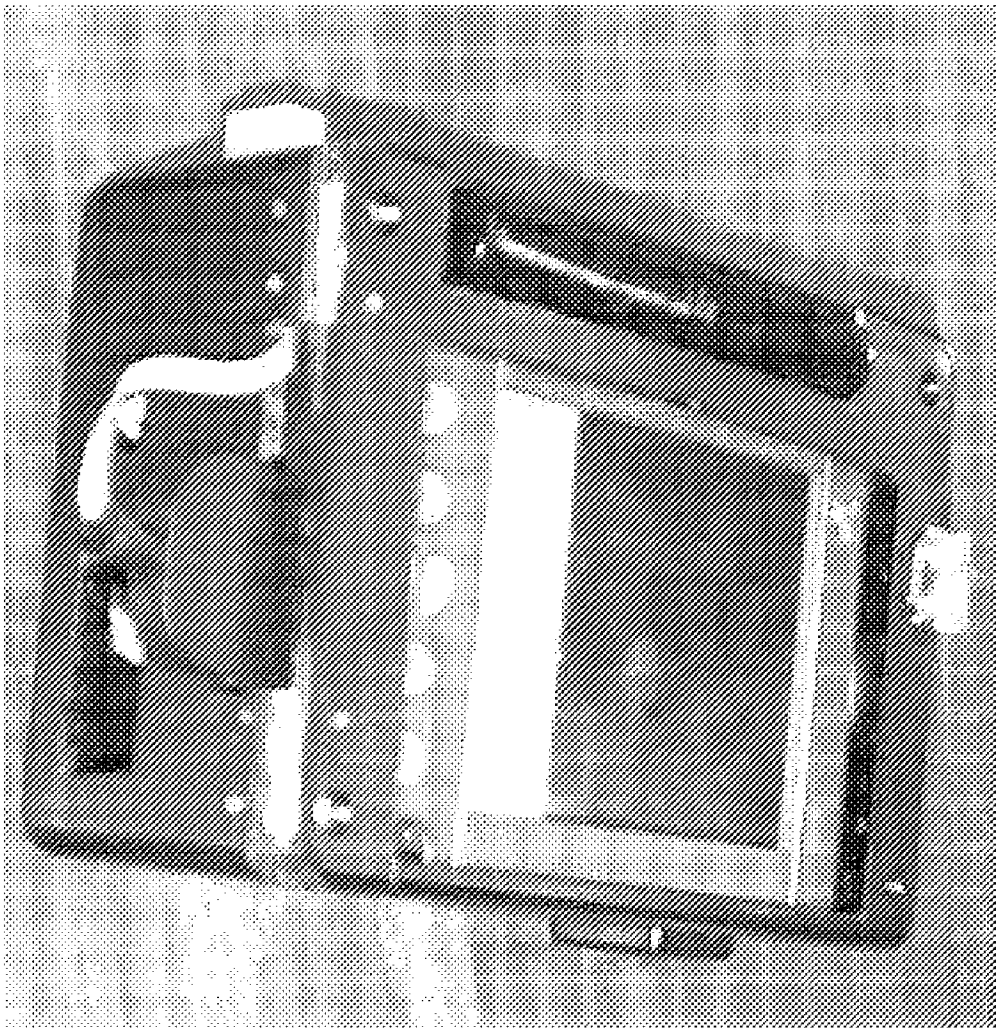
Figure 1B:
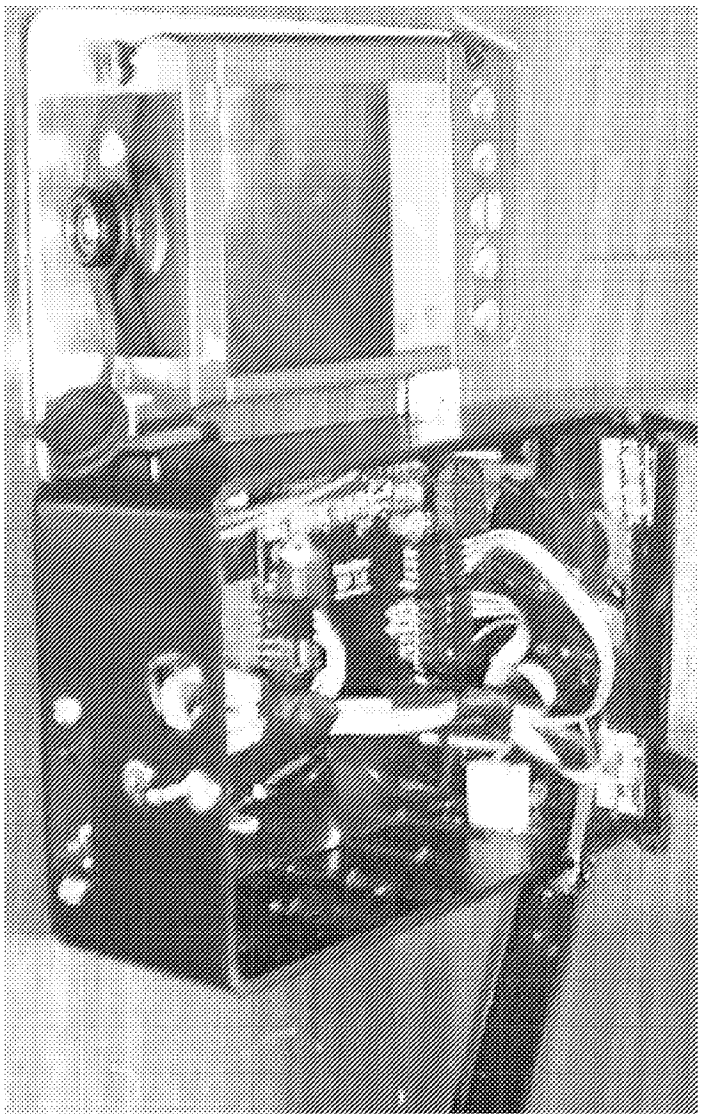
Figure 1C:
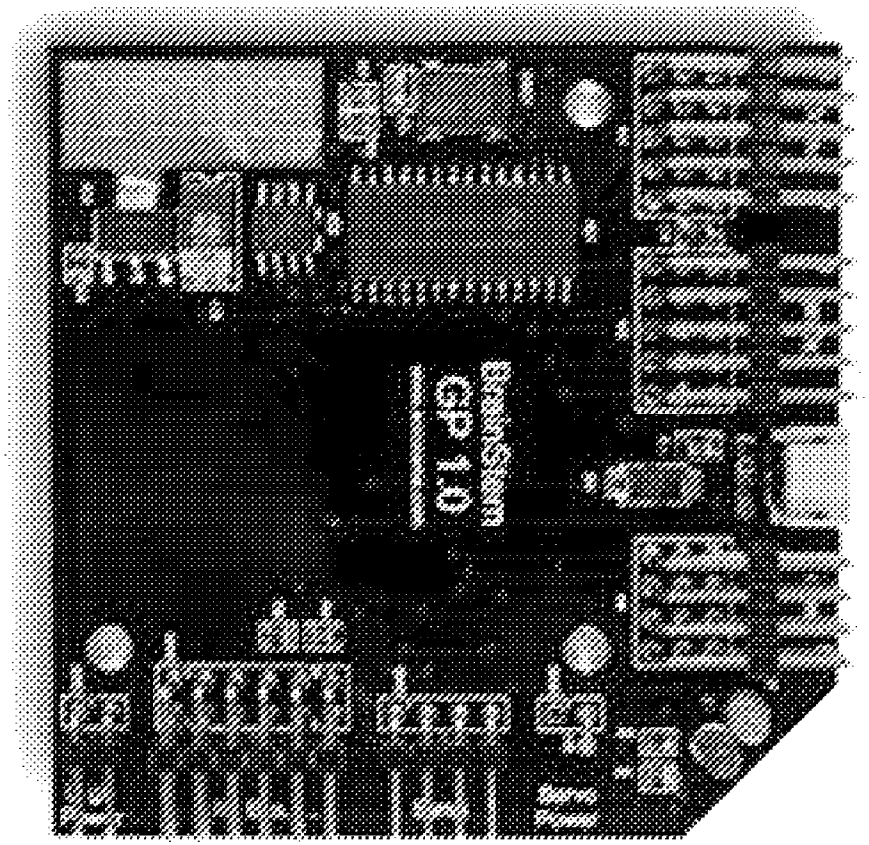
Figure 1D:
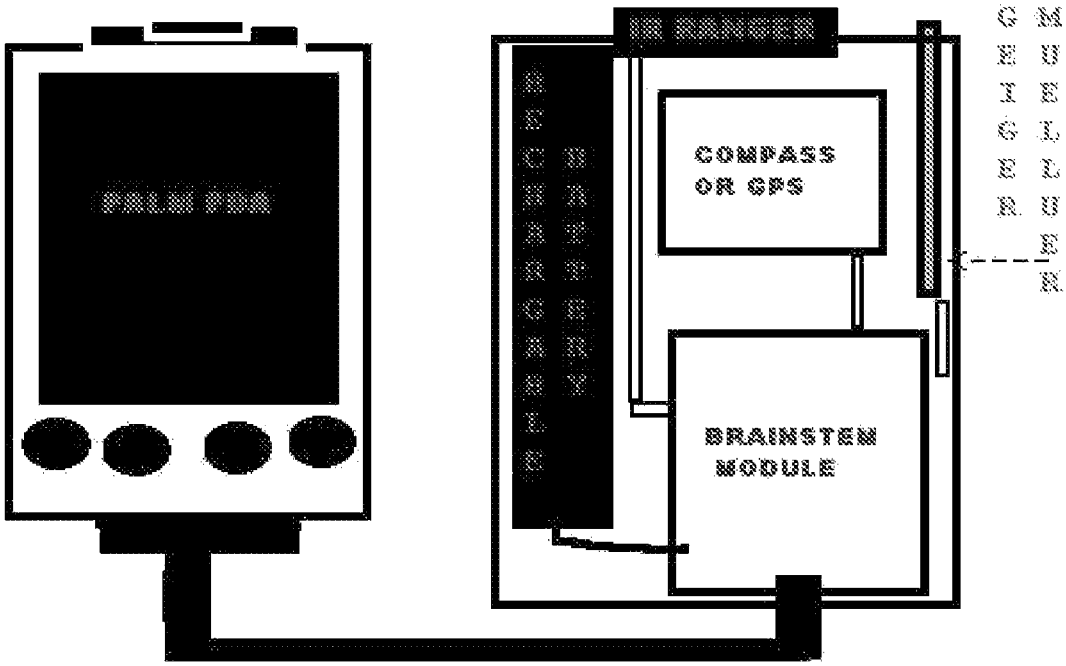
Figure 1E:
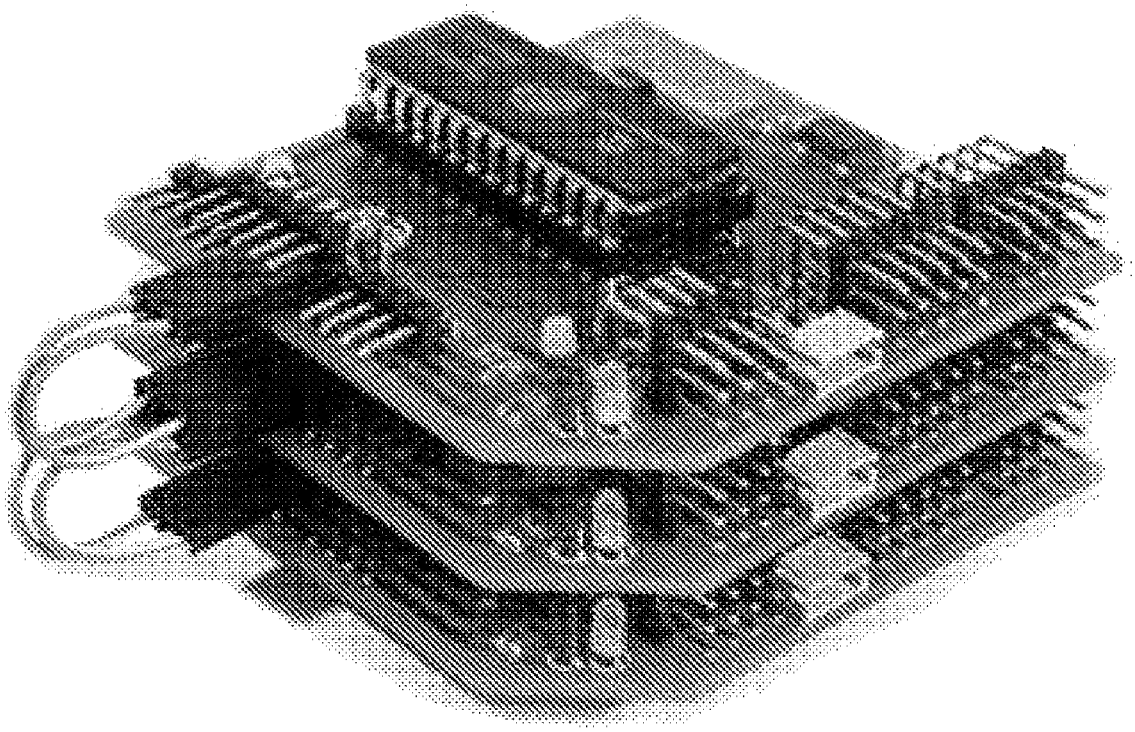

This patent application does not attempt to patent the Language inside the Acroname BrainStem Board, but the program I had written to take advantage of what is present on the Acroname BrainStem board. Combined with the low power sensors attached to each Pin set (positive and negative) either a character or electrical impulse is sent to activate, read and in some cases, have the unit shut down the sensor to save electricity from either a plain 9-volt battery or the 9.6 rechargeable battery as shown in FIG. 1*a*. The sensors researched for the patent and the ones put in use, use up to 5 mille volts of power and they can take 3 to 5 mille seconds to respond. For all four sensors in FIG. 1*d* to respond, the strobing of each set of pins takes in reality only less than a second. It is up to the user to request or add additional sensors (gas sniffers, infrared devices or other sensors), the program was written to access each set of all set of 12 pin sets every three seconds.

The Handheld Scanner shown in FIG. 1*a* is designed to operate both the PDA and Sensor Pack from a 9.6 rechargeable Lithium Ion Battery. The way the Prism is built, two wires can fool the Prism to think it's recharging because the PDA is attached to the Sensor Pack, the length of RS232 cable can be quite long. So the Sensor Pack can be fixed and powered by the rechargeable battery, a vehicle or buildings power supply. If the Sensor Pack is fixed and power is generated from an electrical outlet, the power limitations and number of sensors is irrelevant, the Sensor Pack can handle any kind of sensor and does not need to be carried by hand. The PDA can be mounted for the Users convenience and powered by a wall socket, vehicle wiring or by its internal rechargeable battery, making it more useful.

This gives the program the ability to hot connect sensors and gives the BrainStem to round robin or read each sensor individually and sent back its data where my program appends this data to a ASCII string, to send the Prism (or other computing device) shown all the data in one burst The memory on the BrainStem is sent to the Prism and is immediately cleared. Acroname has a kit for cameras that fit onto the BrainStem instead of using any camera that may by mounted on any other computing device or if any other computing device lacks a camera. This patent application includes in a general way, a camera to be a sensor if it has to be attached to the BrainStem.

The Prism program, that runs independently of the BrainStem program to collect and send data to the Prism, receives data from the Sensor Pack and processes it on the screen. The Sensor Pack does not have any kind of readable device on it. Its main purpose is to collect data, this makes placement of the Sensor Pack irrelevant to placement in or on the user. The Sensor Pack can be worn on a belt. The prototype shown here creates all devices into one package. Other claims make use of the Sensor Pack to be fixed, or tied to a vehicle or a wall or other surface. The Attachment of the Sensor Pack is dependant of the signal strength of the RS232 cable, as shown in FIG. 1*a*.

If the PDA device can hold a camera, like the EyeModule2 on the Prism pictured in FIG. 1*a*. The PDA devotes a part of the screen to stream the video constantly. The Camera has a mechanical shutter and the PDA software has a software shutter, where pictures can be taken on the scene, or when another sensor sends a value, the program running on the Prism can evaluate it and decide to snap a picture automatically in the prototype scheme. If the user decides to swap a computing device that lacks a camera but wants a camera, added in another way, a camera kit exists for the Acroname BrainStem.

The BrainStem Language accepts commands into it as well. To get the same results, a sensor trigger reporting a high or low event can go from the BrainStem program, to the Prism Program. The Prism Program can tell the BrainStem program to use its camera to record the image and send it back in the next stream of data. This is not part of the prototype but it can be done. While MONROE and the PICO devices already can be configured this way, I withdrew this claim, but the camera is an instrumental part of any array of sensors, the potential use and the way it can be proven it will work in the prototype may preclude it in part, but not of the whole.

The Handheld Scanner Prototype is meant to be carried by users by hand. The limits of the sensors may be programmed to alert the User or to trigger other operation automatically. This patent application takes in sensors not available at the time of MONROE device (U.S. Pat. No. 6,518,881), which MONROE DEVICE makes no claims for a Nitrate Sensor released for use in 2005. MONROE has no teachings or it is not obvious how it will handle new devices.

Lastly, The claims will show how it can be used in detail. The User also has access to all normal in the shown Prism software, like the Palm OS Notepad, to take notes at the time of the event. Nor the use or exercise of the Prism internal clock and calendar, which can report or log date and time during an Event. The Visors' EyeModule2 Software uses a Time and Date stamp when it records a picture when one of the shutters are pressed, or activated by a software trigger. The Continuation in part shows flexibility of sum or the third party software as advantage, some of which may be precluded by MONROE or the PICO devices, but adds to, not subtracts from application and the Device usefulness.

The language inside the Application Six claims was rejected by the Examiner due to MONROE U.S. Pat. No. 6,518,881). This Continuation in part includes here, appended, what MONROE does not teach or it is not obvious in the MONROE DEVICE. The MONROE DEVICE is basically surrounds itself primarily with a Patrol Car or Police Stop, for instance, the use of a Credit Card swiper either on the PDA or on the Laptop to check the Drivers License. Most the claims are made around this premise. The Sensors are affixed in certain positions and are hard wired into the vehicles electrical system to get power. They are also had to be hardwired inside the same vehicle to send data. The many of the sensors need to be close to and/or in line of sight of an event or source of what they are capable to detect. None of my research makes sensors available that perceive or send that data in any other manner than wiring. That may change, but MONROE does not anticipate this. MONROE device makes no claim on new sensors, anticipates changes, or any obligation in performing its duties while operating in a vehicle.

MONROE uses a GIEGER COUNTER as a broad description of the Geiger Muller tubes out there. The Geiger Muller and other tubes that detect do detect broad-spectrum radiation subjected to open air. As articles appear about concealment and creation about dirty bombs arise, where a small amount of radioactive material is used in conjunction with a very high explosive, spreading the containment around by the explosion, but poisoning as many people around in reach of the bomb. The MONROE claims do not teach or it is not obvious how the MONROE device can detect a threat until a dirty bomb explodes, accidental spill of radioactive contrast used in medical buildings, and level of radioactive elements other such incidents must be high for the MONROE device to catch is neither taught nor is not obvious.

Saying this about sensor operation, What Monroe does not teach nor is not obvious, is that in my research of the sensors, MONROE uses higher powered sensors, but with the exception of a few, the position of the Vehicle may hinder or obstruct obtaining the data that MONROE claims. Nor does it teach nor is not obvious how a vehicle can reach or obtain data like heat, C02, or other outgases from inaccessible spaces like interior building rooms, halls, crawlspaces or ductwork. It can not fully use alerts of a singular sensors range (high or low) to trigger an automatic operation if the sensor is obstructed by the vehicle or the event is inaccessible to the vehicle by physical barriers, distance or obscured hazards, like water (pools, lakes, rivers), smoke and/or heat, that may be harmful to the vehicle and user themselves before the MONROE device can or maybe able to alert the user.

MONROE does not teach or it is not obvious how a car approaching a radioactive or burning building with a lake in front to the building which creates its own immediate weather.

It does not teach nor is not obvious how the MONROE device can send and receive data to and from the device nor control the PDA except through cellular communications As Hurricane Katrina as shown, Cellular towers can be destroyed or robbed of power. Sep. 11, 2001 has shown us, Cellular traffic after a major attack can destroy or cause so much traffic on cellular towers that the Cellular traffic, so this is not obvious how the MONROE device can do this in such dramatic events.

The PDA that MONROE device has claimed does not teach nor is it obvious how the device can snap a picture, clear the PDAs memory in storing the picture. These functions, including using the PDA to use its on board camera, as claimed in MONROE, must be done by a user.

The invention claimed is:

1. A system for monitoring hazardous conditions detected in a 360 degree manner surrounding the system Including:

A Computing device comprising:

A screen to display information; and

A Memory for storing information; and

An operating system for controlling the operation of the computing device; and

A software machine for controlling actions; and

A Sensor Pack that is operably connected to the computing device, the Sensor Pack comprising:

A BrainStem robotic controller for controlling the operation of the Sensor Pack; and A plurality of color cameras and Sensors for detecting surrounding conditions, the Sensors being operably connected to the BrainStem robotic controller, the Sensors including sensors for heat, motion, direction, distance, radiation, UV radiation, smoke, and Global Positioning System (GPS) information; and A software machine on the BrainStem robotic controller to query each sensor mounted; and A Power Supply that provides power to smaller computing devices and the Sensor Pack, the Power Supply being selected from the group consisting of a rechargeable lithium-ion battery, or by pronged cord attached to a vehicle battery or a standard AC power source; and Wherein the BrainStem robotic controller receives sensor Information from the Sensors and transmits the sensor information to the computing device for constant display of the information to the computing device screen, and/or to the computing device memory and/or alerting a user.

2. The claimed system according to claim 1 further comprising a Software machine on the computing device comprising;

user interface to change and/or add new sensors thresholds and storing them; and A monitor of values when the threshold is reached, the software machine queries the Sensors on the BrainStem and records the information as it is received, attaches a timestamp to the information, activates the camera and records all the information.

3. The claimed system according to claim 2 further comprising when the said Computing device becomes contaminated, whereby the total of the data stored in the said computing device can be remotely ordered to transmit to another Computing Device and then the contaminated device can be disposed of.

4. The claimed system according to claim 1 further comprising a software Machine on the BrainStem robotic controller comprising;

Additional Sensors are hot-swapped into the system and controlled by the BrainStem robotic controller; and A user interface on the Software Machine to the Computing device to set or reset current Sensors the values they need to respond, to add or remove a Sensor on the BrainStem; and A command inside the Software Machine to activate cameras or other Sensors not affixed on the BrainStem, affixed to the Computing Device instead.

5. The claimed system according to claim 1 further uses said Sensors comprising;

Said Sensors are continuously read by the said BrainStem robotic controller in round robin fashion each second, whereby the Sensors are not blocked by the system itself are not limited by obstacles of materials used in the system and can sense in any direction; and Said Sensors sends current positions for mapping software, compass directions, current temperature, current Images, current distance to any object near the Sensor; and The amount of added Sensors to the said BrainStem robotic controller is expandable to include additional Sensors up to the functional limit of the said BrainStem robotic controller.

6. The claimed system according to claim 1 further comprising of a longer serial cable, whereby the said Sensor Pack is attached by the longer serial Cable, allowing the Sensors to work in hazardous confines while the said Computing device can serve as a remote monitor.

* * * * *